United States Patent [19]

Urvantsev et al.

[11] Patent Number: 4,954,248

[45] Date of Patent: Sep. 4, 1990

[54] ELECTRICAL DRUM-TYPE SEPARATOR

[76] Inventors: Anatoly I. Urvantsev, ulitsa Panelnaya, 11a, kv. 30; Jury S. Elantsev, ulitsa Bardina, 3, korpus 3, kv. 1; Alexei M. Komlev, ulitsa P. Tolyatti, 7, kv. 53; Saliman K. Kusembaev, ulitsa Sofii Perovskoi, 103, kv. 23, all of Sverdlovsk; Jury I. Stepanov, Svetlanovsky prospekt, 79, kv. 146; Viktor P. Vasiliev, Nevsky prospekt, 27, kv. 43, both of Leningrad, all of U.S.S.R.

[21] Appl. No.: 294,561

[22] PCT Filed: Apr. 21, 1987

[86] PCT No.: PCT/SU87/00043

§ 371 Date: Dec. 16, 1988

§ 102(e) Date: Dec. 16, 1988

[87] PCT Pub. No.: WO88/08331

PCT Pub. Date: Nov. 3, 1988

[51] Int. Cl.[5] ..... B03C 7/12

[52] U.S. Cl. ..... 209/127.1; 209/127.4

[58] Field of Search ..... 209/127.1, 127.4, 129, 209/130, 128; 15/1.5 R

[56] References Cited

U.S. PATENT DOCUMENTS

| | | | |
|---|---|---|---|
| 3,322,275 | 5/1967 | Breakiron et al. | 209/127.1 |
| 4,116,822 | 9/1978 | Webb | 209/127.1 X |
| 4,251,353 | 2/1981 | Knoll | 209/127.1 X |

FOREIGN PATENT DOCUMENTS

| | | | |
|---|---|---|---|
| 700977 | 12/1940 | Fed. Rep. of Germany | 209/127.1 |
| 602226 | 4/1978 | U.S.S.R. | 209/129 |
| 939090 | 8/1980 | U.S.S.R. . | |
| 1289549 | 2/1987 | U.S.S.R. . | |

OTHER PUBLICATIONS

"Separatorshchik elektricheskikh separatorov", by A. V. Degtyarev et al., pp. 27, 28 and 54, no date. U.S.S.R. Publication, 1983, pp. 234, 235.

*Primary Examiner*—Donald T. Hajec

*Attorney, Agent, or Firm*—Fleit, Jacobson, Cohn, Price, Holman & Stern

[57] ABSTRACT

The electrical drum-type separator for separating a mixture of electrically non-conductive and conductive particles, comprising a housing (1) having a drum (3) mounted therein for rotation about a vertical axis, serving as a precipitation electrode, means (5) for feeding a mixture of loose materials onto the peripheral surface of the drum, at least two corona-discharge electrodes (10) for charging particles of the mixture of loose materials in the electric field set up between each corona-discharge electrode and a portion of the peripheral surface of the drum (3), and brushes (15) for sweeping non-conductive particles off the peripheral surface of the drum, equalling in number the corona-discharge electrodes. The corona-discharge electrodes (10), and brushes (15) are spaced substantially uniformly about the peripheral surface of the drum (3) underlied by receptacles (17,18,19) equalling in number the corona-discharge electrodes (10), arranged in the paths of the streams of electrically conductive particles, aggregates of electrically conductive and non-conductive particles, and non-conductive particles.

5 Claims, 1 Drawing Sheet

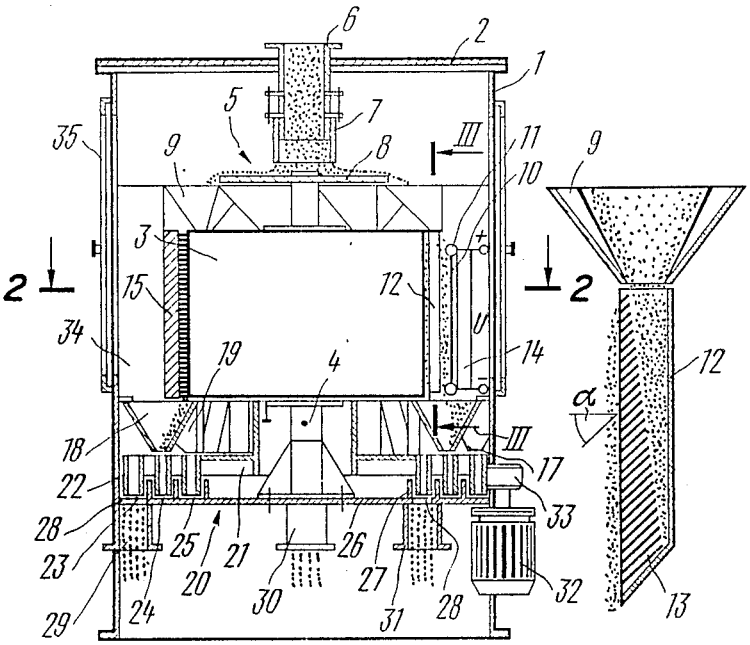
FIG. 1
FIG. 3
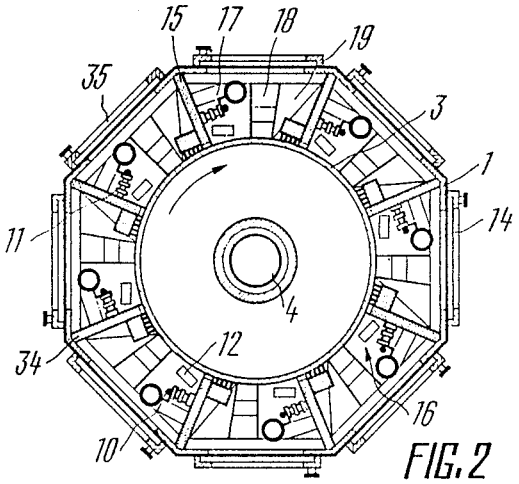
FIG. 2

ELECTRICAL DRUM-TYPE SEPARATOR

TECHNICAL FIELD

The present invention relates to apparatus for separating a mixture of loose materials, and more particularly it relates to an electrical drum-type separator operable for separating a mixture of electrically conductive and non-conductive loose materials.

BACKGROUND OF THE INVENTION

At present, techniques of electrical separation have found a broad field of applications in industries, either as a final operation of a treatment technology, or as a preparatory operation for concentration processes. All the electrical separators are of the single-feed kind which puts definite restraints on their productivity.

Therefore, so far an increased throughput of drum-type electrical separators has been attained either by extending the length of the drum where the separation takes place or by providing a multi-unit separator assembly where several separators are arranged in horizontal and vertical rows, with the resulting loss of floor area, design and maintenance complications.

There is known an electrical drum-type separator for separating a mixture of electrically conductive and non-conductive materials (A. V. Degtyarev et al., "Separatorshchik elektricheskikh separatorov", Nedra/Moscow/ pp. 27, 28, 54), comprising a housing having mounted therein a rotatable drum serving as a collecting electrode, means for feeding a mixture of loose materials onto the peripheral surface of the drum, a corona-discharge electrode for applying an ion charge to particles of the mixture of loose materials in an electric field produced between the electrode and a portion of the peripheral surface of the drum, spaced from the peripheral surface of the drum, a brush for sweeping non-conductive particles off the surface of the drum, mounted behind the corona-discharge electrode in the direction of rotation of the drum, and receptacles arranged in the respective paths of electrically conductive particles, aggregations of conductive and non-conductive particles, and non-conductive particles.

In this known electrical drum-type separator the drum is so arranged that its axis of rotation extends horizontally, the means for feeding the mixture of loose materials onto the peripheral surface of the drum including a feeder having a feeding slit extending along the generatrix of the peripheral surface of the drum. Arranged intermediate the corona discharge electrode also extending along the generatrix of the peripheral surface of the drum and the brush is an electrostatic electrode extending parallel with the corona-discharge electrode. The receptacles arranged in the respective paths of electrically conductive particles, aggregates of conductive and non-conductive particles, and non-conductive particles, underlie the drum.

The corona-discharge electrode, the electrical electrode, the brush for sweeping electrically conductive particles off the peripheral surface of the drum in combination with the portion of the peripheral surface of the drum, lying therebetween, define a separation zone where the separation of a mixture of loose materials takes place.

The throughput of this known electrical drum-type separator is predominantly dependent on the length of the drum serving as the collecting electrode. A certain increase in the throughput can be also attained by stepping up the diameter of the drum, because in this case the drum can be rotated at a higher peripheral speed without non-conductive particles being thrown off its peripheral surface by the centrifugal forces acting upon the particles when the drum revolves. However, this approach to increasing the throughput of a separator results in its overall dimensions being increased, and the area of the peripheral surface of the drum not taking part in the separation process also increasing, this area amounting to at least one third of the entire peripheral surface area of the drum.

With the drum of the known separator extending horizontally, a mixture of loose materials can be supplied only to one portion of its peripheral surface, so that the process of separation is carried out in a single separation zone irrespective of the drum diameter.

From engineering design considerations, the length of the drum of the known separator would not be made greater than some 3000 mm, and its maximally attainable throughput is about 1.5 $m^3/h$ of feed material.

The aforementioned multi-unit arrangement of drum-type separators into a separation unit requires a complicated mechanical system of driving several drums, which complicates both the design and operation.

SUMMARY OF THE INVENTION

It is an object of the invention to create an electrostatic drum-type separator wherein the drum arrangement, the quantity of the corona-discharge electrodes, brushes and receptacles for electrically conductive particles, non-conductive particles and aggregates of conductive and non-conductive particles should provide for utilizing the entire peripheral surface of the drum in the process of separation.

This object is attained by providing an electrical drum-type separator for separating a mixture of electrically conductive and non-conductive loose materials, comprising a housing having mounted therein a rotatable drum serving as a collecting electrode, means for feeding a mixture of loose materials onto the peripheral surface of the drum, a corona-discharge electrode for charging particles of the mixture of loose materials in an electric field set up between the corona-discharge electrode and a portion of the peripheral surface of the drum, spaced from the peripheral surface of the drum, a brush for sweeping non-conductive particles off the peripheral surface of the drum, arranged behind the corona-discharge electrode in the direction of rotation of the drum, and receptacles arranged in the respective paths of the streams of conductive particles, non-conductive ones and aggregates of both, in which separator, in accordance with the present invention, the drum is mounted so that its axis of rotation extends vertically, there being provided at least one additional corona-discharge electrode spaced from the peripheral surface of the drum, and additional brushes arranged behind (1) said additional corona discharge electrode in the direction of rotation of the drum for sweeping non-conductive particles off, the drum surface, and additional receptacles arranged in the respective paths of the additional streams of electrically conductive particles, non-conductive ones and aggregates of both, the said main and additional corona-discharge electrodes and brushes being spaced substantially uniformly about the periphery of the drum, and the said main and additional receptacles being arranged to underlie the drum.

It is expedient that the electrical drum-type separator should additionally include electrostatic electrodes arranged intermediate each one of said corona-discharge electrode and brush respectively.

It is reasonable to have the means for feeding a mixture of loose materials onto the peripheral surface of the drum overlying the drum and including a table feeder arranged coaxially with the drum, and funnels in a number equalling that of the main and additional corona-discharge electrodes, underlying the plate feeder, the outlet of each funnel facing the space between the respective corona-discharge electrode and the peripheral surface of the drum.

It is also reasonable to have the means for feeding a mixture of loose materials onto the peripheral surface of the drum additionally including chutes in a number equalling that of the funnels, each chute being arranged vertically in the space between the respective corona-discharge electrode and the peripheral surface of the drum under the outlet of the funnel, its open part facing the peripheral surface of the drum and having shelves uniformly spaced vertically thereof, the shelves extending at an angle in excess of the angle of repose of the mixture of loose materials, the length of each successive shelf in the downward direction exceeding the length of the preceding shelf.

It is further expedient for the electrical drum-type separator to include additionally means for discharge of electrically conductive particles, aggregates of electrically conductive and non-conductive particles, and non-conductive particles, including a bladed rotor mounted in the housing under the drum coaxially therewith, and annular passages in a number equalling that of the main receptacles, communicating each with the corresponding main and additional receptacles, the passages being formed by partitions concentrically arranged in the housing, each annular passage having a discharge opening made therein, and the blades of the rotor extending into the respective annular passages.

The throughput of the herein disclosed electrical drum-type separator is dependent both on the length of the drum and its diameter, the dimension of this diameter defining the number of corona-discharge electrodes, electrostatic electrodes and brushes that can be accommodated about the periphery of the drum. Thus, in the herein disclosed electrical drum-type separator the process of separation of a mixture of loose materials can be carried out in several separation channels, so that the entire peripheral surface of the drum would utilized.

In a separator of the herein disclosed structure, it has been found feasible to attain a throughout of up to 30 $m^3/h$ with the drum length being 1000 mm and its diameter 2000 mm, its specific values such as the volume or mass of the separator per unit of its throughput being one fifth to one fourth of those of the separator of the prior art. To attain the same throughput in the abovedescribed multi-unit separator unit, it would have taken some 20 drums 3000 mm long.

The herein disclosed electrical separator has a single drive system and relatively small overall dimensions, facilitating both its manufacture and maintenance.

BRIEF DESCRIPTION OF THE DRAWINGS

The present invention will be further described in connection with its embodiment, with reference being made to the accompanying drawings, wherein:

FIG. 1 is a longitudinally sectional view of an electrical drum-type separator embodying the invention;

FIG. 2 is a sectional view taken on line II—II of FIG. 1;

FIG. 3 is an enlarged-scale sectional view taken on line III—III of FIG. 1.

BEST MODE FOR CARRYING OUT THE INVENTION

The electrical drum-type separator for separating a mixture of electrically non-conductive and conductive materials comprises a housing 1 (FIG. 1) with a cover 2, having mounted therein a rotatable drum 3, the drum 3 being mounted for rotation on a vertical shaft 4 and serving as a collecting electrode. Mounted in the housing 1 above the top end of the drum 3 is the means 5 for feeding a mixture of loose materials onto the peripheral surface of the drum 3, including in the presently described embodiment a loading pipe 6 mounted in the cover 2 of the housing 1 and provided with a throat 7 mounted for axial adjustment on the pipe 6 for controlling the rate of feed of the mixture of loose materials, a table feeder 8 arranged coaxially with the drum 3, and funnels 9 underlying the feeder 8. Spaced from the peripheral surface of the drum 3 are at least two corona-discharge electrodes 10 (there are eight corona-discharge electrodes 10 in the presently described embodiment, as can be seen in FIG. 2), substantially uniformly spaced about the periphery of the drum 3 and adapted to charge the particles of the mixture of loose materials in the electric field set up between each respective corona-discharge electrode 10 and the corresponding portion of the peripheral surface of the drum 3. Each corona-discharge electrode 10 (FIG. 1) is in the form of a wire extending along the generatrix of the peripheral surface of the drum 3 between a pair of support insulators 11.

The quantity of the funnels 9 of the means 5 for feeding the mixture of loose materials onto the peripheral surface of the drum 3 corresponds to the number of the corona-discharge electrodes 10, their outlets facing the spaces between the respective corona-discharge electrodes 10 and the peripheral surface of the drum 3. In the presently described embodiment the means 5 for feeding the mixture of loose materials upon the peripheral surface of the drum 3 also includes chutes 12 in a number equal to that of the funnels 9, each chute 12 extending vertically in the space between the respective corona-discharge electrode 10 and the peripheral surface of the drum 3, under the outlet of the funnel 9. Each chute 12 has its open part facing the peripheral surface of the drum 3 and has shelves 13 (FIG. 3) uniformly spaced vertically thereof, the shelves 13 extending an at angle $\alpha$ in excess of the angle of repose of the mixture of loose materials being handled, the angle $\alpha$ in the presently described embodiment being about 45°.

The length of each successive shelf 13 in the downward direction exceeds the length of the preceding shelf 13 by the same extent. The shelves 13 are intended to distribute the mixture of loose materials substantially uniformly over the respective portion of the peripheral surface of the drum 3.

The chutes 12 with their shelves 13 are recommended is cases when the mixture of loose materials contains a large proportion of electrically conductive particles, to prevent occurrence of spark break-downs between the corona-discharge electrodes 10 and the drum 3 serving as the collecting electrode.

Mounted behind each corona-discharge electrode 10 (FIGS. 1 and 2) in the direction of rotation of the drum 3 (this direction of rotation is indicated by a curved arrow in FIG. 2) is an electrostatic electrode 14 in the form of a dielectric-coated metal tube mounted on the support insulators 11 parallel with the corona-discharge electrode 10.

The pairs of corona-discharge and electrostatic electrodes 10, 14 are connected to sources of d.c. voltage U of the same polarity (the terminals of one such voltage source are indicated conditionally in FIG. 1).

Arranged behind each electrostatic electrode 14 in the direction of rotation of the drum 3, along the generatrix of its peripheral surface, is a brush 15 for sweeping non-conductive particles off the peripheral surface of the drum 3.

The corona-discharge electrode 10, its respective electrostatic electrode 14, brush 15 and the portion of the peripheral surface of the drum 3 extending therebetween jointly define a separation channel 16 (FIG. 2). Thus, the separator of the presently described embodiment defines eight separation channels 16 whose number is generally dependent on the feasibility of accommodating about the drum 3 of a given diameter, the sets of corona-discharge and electrostatic electrodes 10, 14 and brushes 15.

Underlying the drum 3 successively in the direction of its rotation are receptacles 17, 18, 19 arranged in the respective paths of the streams of electrically conductive particles, aggregates of electrically conductive and non-conductive particles, and non-conductive particles, the quantity of these receptacles being determined, in general, by the number of fractions into which the mixture of loose materials is separated. Thus, when a mixture of loose materials containing particles with different values of conductivity is to be separated, several receptacles 17 are provided, of which the one that is the closest to the corona-discharge electrode 10 would receive particles having the greatest value of conductivity, and other receptacles 17 succeeding it in the direction of rotation of the drum 3 would receive particles with correspondingly smaller conductivity values.

To facilitate the removal of the separated fractions, the presently described electrical drum-type separator comprises the means 20 (FIG. 1) for discharging electrically conductive particles, aggregates of electrically conductive and non-conductive particles, and non-conductive particles, including a rotor 21 mounted in the housing 1 under the drum 3 coaxially therewith, having blades 22 extending into annular passages 23, 24, 25 in a number equalling the number of the receptacles 17, 18, 19 in a single separation channel 16 (FIG. 2). The annular passage 23 communicates through corresponding slots in the rotor 2 with all the receptacles 17, the annular passages 24 with all the receptacles 18, and the annular passages 25 with all the receptacles 19. The annular passages 23, 24 and 25 are defined by partitions 27 concentrically arranged on the bottom of the housing 1, and are intended for collecting therein, respectively, electrically conductive particles, aggregates of electrically conductive and non-conductive particles, and non-conductive particles. Each of the annular passages 23, 24, 25 has its own discharge opening 28. The blades 22 of the rotor 21 extend into the annular passages 23, 24, 25 for running therealong, the discharge openings 28 communicating with discharge pipes 29, 30, 31 for withdrawing electrically conductive particles, aggregates of electrically conductive and non-conductive particles, and non-conductive particles from the herein described electrical drum-type separator.

The drum 3, table feeder 8 and rotor 21 are electrically grounded and driven for rotation by means of a friction-type drive including a drive motor 32 and a driving wheel 33 frictionally engaging the rotor 21.

The separation channels 16 (FIG. 2) are separated by vertical dividing partitions 34 (FIGS. 1 and 2), and the housing 1 is provided with glass-panel doors 35 for adjustment and maintenance work, as well as for visually monitoring the separation process.

The electrical drum-type separator of the present invention operates, as follows.

Fixed d.c. voltage U from the high-voltage sources is fed to the corona-discharge and electrostatic electrodes 10, 14 (FIGS. 1 and 2) of the separator. A corona-discharge electric field is set up between the corona-discharge electrodes 10 and the drum 3 serving as the collecting electrode, and an electrostatic field is established between the electrostatic electrodes 14 and the drum 3. Then the electric motor 32 (FIG. 1) is energized to transmit rotation through the driving wheel 33 to the rotor 21 which starts rotating jointly with the drum 3 and the table feeder 8 in the direction from the corona-discharge electrodes 10 towards their respective brushes 15.

The feed mixture of electrically conductive and non-conductive loose materials to be separated is supplied via the feeding pipe 6 and throat 7 to the revolving plate feeder 8, the centrifugal forces driving the mixture to the periphery of the plate feeder 8. The feed rate of the mixture is determined by the gap set between the bottom end of the throat 7 and the plate feeder 8 at the adjustment stage. The mixture is thrown off the edge of the revolving plate feeder 8 into the funnels 9 of all the separation channels 16 (FIG. 2), either falling directly into the gap between the peripheral surface of the drum 3 (FIG. 1) and the corona-discharge electrode 10 of each channel from the outlet of the respective funnel 9, or else being distrubuted in this gap with the aid of the chute 12. In the first-mentioned case the mixture is distributed in a thin layer under gravity forces and under the action of the corona discharge field and the electrostatic field, along the generatrix of the peripheral surface of the drum 3. In the second-mentioned case the mixture enters, first, the chute 12 to become distributed there uniformly on the inclined shelves 13 (FIG. 3) and to slide down towards the peripheral surface of the drum 3 (FIG. 1).

In either case, in each separation channel 16 (FIG. 2) all the particles making up the mixture of the loose materials receive an electrostatic charge of the same sign as the polarity of the corona-discharge electrode 10, so that they are repelled by the latter in the direction towards the periphery of the drum 3 which is electrically grounded, settling on this periphery. The charged particles are also acted upon by the electrostatic field of the elestrostatic electrode 14 of the same polarity as the corona-discharge electrode 10, this action assisting in driving the particles towards the drum 3.

Upon contacting the drum 3, each particles loses there its ion charge. Electrically conductive particles are the first to lose their charge, i.e. they discharge quickly and move down by gravity, the electrostatic field of the electrode 14 influencing this downward path of the particles towards the respective receptable 17 arranged in the path of the stream of electrically conductive particles. Electrically non-conductive particles of the mixture of loose materials are considerably less quick to lose their electrostatic charge, so that they are retained on the peripheral surface of the drum 3, this retaining phenomenon being assisted by the action of the electrostatic field of the electrode 14. Thus, they are carried by the periphery of the drum 3 towards the brush 15 which sweps them off this surface into the underlying receptacle 19 (FIG. 1) for non-conductive particles.

Aggregates of electrically conductive and non-conductive particles, same as very fine conductive particles and coarse non-conductive particles that would not be retained on the periphery of the drum 3 find their way into the receptacle 18. It can be seen from the above-said that the composition of particles in the receptacle 18 is quite various, which is also due to the fact that in the process of separation the mixture of loose materials reaches the peripheral surface of the drum 3 in a multi-layer flow, and not all particles find themselves in the same conditions in the area of action of the corona-discharge and electrostatic electrodes 10, 14, and this results in their different interaction with the precipitation electrode, i.e. the drum 3. On the other hand, with the mixture of loose materials being fed onto the peripheral surface of the drum 3 in the separator of the present invention from above, in a vertical flow, they are intensely mixed up, which enhances the selective character of the separating operation.

The use of the structurally more simple means 5 for feeding the mixture through the funnels 9 directly into the gaps between the peripheral surface of the drum 3 and the respective corona-discharge electrodes 10 is advised when the mixture being handled contains relatively little electroconductive particles (e.g. up to 25%), which is the case, for instance, in the operation of reconditioning molding sands. With a higher content of conductive particles in a mixture, spark break-downs occur between the corona-discharge and electrostatic electrodes 10, 14 and the drum 3, adversely affecting the separation process.

For separation of a mixture of loose materials with a relatively high percentage of electrically conductive particles it is more advisable to employ the more complicated mixture-feeding means 5 additionally including the chutes 12 with their shelves 13, which significantly reduce the number of spark breakdowns between the corona-discharge and electrostatic electrodes 10, 14 and the drum 3. With a mixture of loose materials thus fed, its particles slide down the inclined shelves 13 of the chutes 12 towards the peripheral surface of the drum 3 at an angle $\alpha$ (FIG. 3) to the generatrix of the peripheral surface of the drum 3 (FIG. 1) and have a tangential component of their velocity with respect to the drum 3, in the direction of its rotation. This promotes detachment of electrically conductive particles from the peripheral surface of the drum in the zone behind the corona-discharge and electrostatic electrodes 10, 14 and brings down the probability of spark break-downs.

Thus, in the electrical drum-type separator being described a mixture containing electrically conductive and non-conductive particles, and their aggregates supplied to the peripheral surface of the drum 3 serving as the precipitation electrode is separated in eight separation channels 16 (FIG. 2) under the joint action of the electric fields set up by the corona-discharge and electrostatic electrodes 10, 14 and of the brushes 15. In this operation the entire peripheral surface of the drum 3 (FIG. 1) is used, which steps up significantly the throughput of the separator. The throughput of the separator may be additionally enhanced in the same way as the throughput of electrical drum-type separators of the prior art is enhanced, i.e. by increasing the length of the drum 3 and its peripheral speed.

From the outlets of the respective receptacles 17, 18, 19, electrically conductive particles, aggregates of electrically conductive and non-conductive particles, and non-conductive particles enter the respective annular passages 23, 24, 25 where the blades 22 of the rotor 21 move them along these passages 23, 24, 25 towards the discharge openings 28, to be withdrawn from the separator through the respective discharge pipes 29, 30, 31.

The unloading means 20 of the presently described structure is quite compact and simple in design. All the revolving parts of the separator of the described design are a single electric motor 32, the operation and maintenance of the separator are facilitated.

It can be seen from the above disclosure that the electrical drum-type separator of the present invention offers a substantial increase of the throughput without its dimensions being correspondingly increased.

INDUSTRIAL APPLICABILITY

The present invention is particularly suitable for concentration of ferrous non-ferrous and rare metal ores, and also for treatment of various mineral raw materials with the particle size not exceeding 1.5 mm. Furthermore, the invention can be employed for separation of materials other than metal ores, such as feldspar, potassium and phosphorus-containing ores, as well as for final treatment of diamond concentrate. An electrical drum-type separator of the herein disclosed type can be also employed in food and glass industries, as well as in rubber utilisation processes.

What is claimed is:

1. An electrostatic drum-type separator for separating a mixture of electrically conductive and non-conductive particles, comprising a housing having mounted thereinside a rotatable drum serving as a precipitation electrode, means for feeding a mixture of loose materials onto a peripheral surface of the drum, a corona-discharge electrode spaced from the peripheral surface of the drum for electrically charging particles of the mixture of loose materials in an electric field set up between the corona-discharge electrode and a portion of the peripheral surface of the drum, a brush for sweeping non-conductive particles off the peripheral surface of the drum, arranged behind the corona-discharge electrode in a direction of rotation of the drum, and main receptacles arranged in a direction of the streams of electrically conductive particles, aggregates of electrically conductive and non-conductive particles, and non-conductive particles, the drum being mounted so that its axis extends vertically, there being provided at least one additional corona-discharge electrode spaced from the peripheral surface of the drum, and additional brushes for sweeping non-conductive particles off the peripheral surface of the drum, equalling in number the additional corona-discharge electrodes, each additional brush being arranged behind the respective one of the additional corona-discharge electrodes in the direction of rotation of the drum, and additional receptacles arranged in the respective paths of the additional streams of electrically conductive particles, aggregates of electrically conductive particles and non-conductive particles, and non-conductive particles, the main and additional corona-discharge electrodes and brushes being spaced substantially uniformly about the periphery of the drum, and the main and additional receptacles being arranged to underlie the drum.

2. An electrostatic drum-type separator as claimed in claim 1, further comprising electrostatic electrodes equalling in number the main and additionally corona-discharge electrodes, arranged each intermediate the respective corona-discharge electrode and brush.

3. An electrostatic drum-type separator as claimed in claim 1, wherein the means for feeding a mixture of loose materials onto the peripheral surface of the drum overlies the drum and includes a plate feeder mounted coaxially with the drum and funnels underlying the feeder, equalling in their number the main and additional corona-discharge electrodes, each funnel having its outlet facing the space between the respective corona-discharge electrode and the peripheral surface of the drum.

4. An electrostatic drum-type separator as claimed in claim 3, wherein the means for feeding a mixture of loose materials onto the peripheral surface of the drum additionally includes chutes equalling in their number the funnels, each chute extending vertically in the space between the respective corona-discharge electrode and the peripheral surface of the drum under the outlet of the respective funnel and having an open part facing the peripheral surface of the drum, and shelves uniformly spaced vertically thereof, extending at an angle in excess of the angle of repose of the mixture of loose materials, the length of each successive shelf in the direction from the top shelf to the bottom one exceeding the length of the preceding shelf.

5. An electrostatic drum-type separator as claimed in claim 1, further comprising means for unloading electrically conductive particles, aggregates of electrically conductive and non-conductive particles, and non-conductive particles, including a rotor with blades mounted in the housing under the drum coaxially therewith, and annular passages equalling in their number the main receptacles, communicating each with the respective main and additional receptacles, the annular passages being defined by partitions concentrically arranged in the housing, each annular passage having a discharge opening, the blades of the rotor extending into the annular passages.

* * * * *